US005135387A

United States Patent [19]

Martin et al.

[11] Patent Number: 5,135,387

[45] Date of Patent: Aug. 4, 1992

[54] NITROGEN OXIDE CONTROL USING INTERNALLY RECIRCULATED FLUE GAS

[75] Inventors: Michael J. Martin, Broken Arrow; William C. Gibson; Lee R. Massey, both of Tulsa, all of Okla.

[73] Assignees: IT-McGill Environmental Systems, Inc.; Tulsa Heaters, Inc., both of Tulsa, Okla.

[21] Appl. No.: 719,520

[22] Filed: Jun. 24, 1991

Related U.S. Application Data

[63] Continuation of Ser. No. 423,145, Oct. 19, 1989, Pat. No. 5,044,932.

[51] Int. Cl.[5] ..... F23L 9/00

[52] U.S. Cl. ..... 431/116; 431/9; 431/181; 431/187; 431/173

[58] Field of Search ..... 431/173, 9, 115, 116, 431/181, 187, 188; 422/182, 183; 110/204, 205, 206, 207

[56] References Cited

U.S. PATENT DOCUMENTS 4,257,763 3/1981 Reed ..... 431/188
4,277,942 7/1981 Egnell et al. ..... 431/116
4,575,332 3/1986 Oppenberg et al. ..... 431/9
4,613,299 9/1986 Backheim ..... 431/116
4,708,638 11/1987 Brazier et al. ..... 431/116

FOREIGN PATENT DOCUMENTS 779381 11/1977 U.S.S.R. .

*Primary Examiner*—Carl D. Price
*Attorney, Agent, or Firm*—Bill D. McCarthy; Glen M. Burdick

[57] ABSTRACT

An improved process and apparatus for reducing $NO_x$ content of flue gas effluent from a furnace, the improvement comprising a burner assembly having a burner and flue gas recirculating system for collecting and passing internally recirculating flue gas into a combustion zone for reaction with a combustion flame. The burner preferably has a plurality of fuel dispensing nozzles peripherally disposed about the combustion zone to aspirate collected internally recirculating flue gas into the combustion zone, and has a plurality of fluid driven eductors to drive further amounts of collected internally recirculating flue gas into the combustion zone.

3 Claims, 3 Drawing Sheets

NITROGEN OXIDE CONTROL USING INTERNALLY RECIRCULATED FLUE GAS

This is a continuation of copending application Ser. No. 07/423,145 filed on Oct. 19, 1989, now U.S. Pat. No. 5,044,932.

BACKGROUND OF THE INVENTION

1. Field of the Invention

The present invention related to the field of combustion equipment, and more particularly but not by way of limitation, to a burner assembly which substantially reduces the nitrogen oxide content of a flue gas effluent from a furnace and the like.

2. Discussion

Oxides of nitrogen are contaminants emitted during the combustion of industrial fuels. In every combustion process, where nitrogen is present, the high temperatures result in the fixation of some oxides of nitrogen. These compounds are found in flue gases mainly as nitric oxide (NO), with lesser amounts of nitrogen dioxide ($NO_2$) and other oxides. Since nitric acid continues to oxidize to nitrogen dioxide in air at ordinary temperatures, the total amount of nitric oxide plus nitrogen dioxide in a flue gas effluent is referred to simply as nitrogen oxides, or $NO_x$, and expressed as $NO_2$.

Emissions of nitrogen oxides from stack gases, through atmospheric reactions, produce "smog". The amount of $NO_x$ in vented gases is regulated by various state and federal agencies, especially in such congested areas as that of the Los Angeles Basin in the State of California. Recent rules of the South Coast Air Quality Management District of that state decree that $NO_x$ emissions cannot exceed 0.03 lbs/MM BTUs, roughly 25 ppm, (parts per million by volume dry), a $NO_x$ level which is below that permitted previously.

Tightening state and federal emission requirements have lead to considerably effort to find ways to remove or prevent the formation of nitrogen oxides in combustion processes so that such gases may be discharged to the atmosphere without further deleterious effect on the environment. Generally, prior art treatment $NO_x$ control has involved two methods. The first is that of the treatment of combustion products, sometimes referred to as post combustion treatment.

One such post combustion treatment for removing nitrogen oxides utilizes an absorption medium to absorb the oxides of nitrogen. However, this method results in the formation of either an acidic liquid or other nitrogen containing noxious liquid streams which must be treated further before safe discharge to the environment.

Other post combustion treatments for removing $NO_x$ have employed catalysts in combination with ammonia injection for selective catalytic reduction (SCR) of $NO_x$ from gaseous effluents. Still other non-catalytic processes have employed ammonia, ammonium formate, ammonium oxalate, ammonium carbonate and the like for selectively reducing $NO_x$ content of gaseous effluents. These injection technologies are limited by the reaction kinetics of the injected chemicals; furthermore, such treatments result in undesirable emissions not created by the combustion process, such as ammonia break through and the like.

Another prior art process for reducing $NO_x$ employs the concept of reducing $NO_x$ in the presence of an excess of a hydrocarbon at elevated temperatures. This process reduces the amount of $NO_x$ in the combustion gases, but products such as carbon monoxide, hydrogen, hydrocarbons and particulate carbon, are produced in such quantities that the release of the gases containing these products is prohibitive until additional steps are taken to further treat the gases. U.S. Pat. No. 3,873,671, issued to Reed et al., provides for the burning of a hydrocarbon fuel with less than the stoichiometric amount of oxygen. Combustion products are provided an excess of oxidizable material under conditions that reduce the $NO_x$ content, and are then cooled to between about 1200° F. to 2000° F. with a fluid which is substantially free of oxygen. To prevent venting excess combustibles into the atmosphere, the cooled mixture of nitrogen, combustion products and other oxidizable materials is thereafter combusted in a second zone with sufficient oxygen to oxidize substantially all of the oxidizable combustion products while minimizing the oxides of nitrogen. This process achieves $NO_x$ emission reduction to about 50 to 100 ppm.

The second method of dealing with $NO_x$ control is that of the prevention of $NO_x$ formation in a combustion process. One such method is external flue gas recirculation in which a portion of the flue gas created by a combustion process is mixed with the inlet air fed to the burner. An example is found in U.S. Pat. No. 4,445,843 issued to Nutcher which taught a low $NO_x$ burner in which flue gas effluent is recirculated to be mixed with combustion air fed to the burner of a furnace. This system, while working in the prevention of $NO_x$ formation, requires additional hardware for flue gas recirculation and has a narrow operating range in terms of effluent oxygen content and flame stability. Achievable $NO_x$ levels with this burner design is a $NO_x$ emission level of about 45 to 60 ppm.

U.S. Pat. No. 4,505,666 issued to Martin, et al. teaches a staged fuel/staged air low $NO_x$ burner which involves creating two combustion zones. The first is created by injecting 40 to 60 percent of the fuel with 80–95 percent of the air, the second by injecting 40–60 percent of the fuel with 5–20 percent of the total air. Achievable $NO_x$ levels with this design have been shown in the 40–50 ppm range. There is no provision for utilizing flue gas recirculation.

U.S. Pat. No. 4,629,413 issued to Micheson et al. discloses a low $NO_x$ premix burner which delays the mixing of secondary air with the combustion flame and allows cooled flue gas to recirculate. A primary air system uses a jet eductor to entrain combustion air and mix it with fuel to pass the air/fuel mixture to a centrally disposed burner tip to be burned. A secondary air system dispenses air from an annular space formed about the burner so that secondary air is fed to the combustion flame, causing a longer time for secondary air to reach the fuel and thus lowering the peak flame temperature. Further cooling to the flame occurs as a result of small amounts of flue gas being entrained into the base of the less than stoichiometric, fuel rich flame, providing cooling and dilution of the flame. The patent shows a $NO_x$ emission level of between about 40 to 120 ppm (corrected to 4% excess oxygen on a dry basis).

With the exception of the Michelson et al. U.S. Pat. No. 4,629,413, the adverse effects of internally recirculated flue gas on flame stability have been avoided. The internal flue gas in a furnace, created by thermal gradients such as in a tubular furnace, is known to recirculate downwardly or back to the burner to interact sufficiently with the flame to cause flame instability or deformation. This deleterious backwash of flue gas was widely recognized and finally obviated by the inclusion of a flue gas deflection barrier which surrounded the burner at a height and spatial orientation to cause the internally recirculated flue gas in the furnace to be diverted away from direct interaction with the flame near the burner. This deflection barrier is well known as a Reed wall.

While $NO_x$ emission control by the above described prior art processes and apparatuses has generally proved satisfactory, tighter governmental restrictions are requiring ever improved performances beyond the capability of some of these burner assemblies, and in some instances, even where the prior art is technically capable of achieving the lower permissible $NO_x$ emission levels, the captial investment and/or increased operating expenses restrict their applications. There is a need, not only with regard to new installations, but also with regard to retrofit applications, for tighter $NO_x$ emission control which minimizes capital outlay and ongoing maintenance and operation expense.

That is, while heretofore known prior art processes and apparatuses are generally capable of reducing $NO_x$ emission levels, numerous disadvantages or limitations are presented by such prior art. The heretofore known prior art processes and apparatuses variously fall to provide full emission control; incur substantial downtime due to complexity of equipment; require addition of objectionable chemicals such as ammonia; or lead to additional emission constituents that are themselves recognized as undesirable. Further, the additional costs, including initial capital outlay and ongoing operating expenses, and the liability exposure presented by the heretofore known prior art processes and apparatuses are undesirable.

SUMMARY OF THE INVENTION

The present invention provides a process and apparatus for the substantial reduction or elimination of $NO_x$ in a flue gas effluent from a furnace in which a fuel is combusted to form a combustion flame in a combustion zone of the furnace, the furnace being of the variety in which internally recirculated flue gas is encountered. In contrast to prior art combustion teachings, internally recirculated flue gas, or downdraft flue gas, is collected and caused to be driven into reaction contact with the combustion flame.

A staged fuel burner assembly is provided with primary and secondary fuel nozzles, and a burner tile is disposed about the central first fuel nozzle which communicates with air inlet port. The secondary fuel nozzles are disposed peripherally about the burner tile. A flue gas collection assembly comprising a barrier member is provided in proximity to the furnace floor to form a flue gas tunnel to collect and pass downdraft flue gas from the furnace walls to the vicinity of the secondary fuel nozzles where it is aspirated into the combustion zone.

A portion of the collected downdraft flue gas is driven into the combustion zone by fluid driven eductors or the like supported to force the flue gas through access openings in the burner tile.

The present invention effectuates a substantial reduction in the $NO_x$ content of the flue gas effluent from the furnace. That is, practice has shown that the total $NO_x$ content of a flue gas effluent without externally recirculated flue gas can be controlled within the range of about 10 to 30 ppm or less.

Accordingly, it is the principal object of the present invention to effectuate substantial reduction in the $NO_x$ content of a flue gas effluent from a furnace or the like.

Another object of the present invention is to achieve substantial reduction in the $NO_x$ content of a flue gas effluent from a furnace or the like without the necessity of externally recirculated flue gas.

Yet another object of the present invention is to achieve the above stated objects while minimizing manufacturing, operating and maintenance costs.

Other objects, features and advantages of the present invention will become clear from the following description when read in conjunction with the drawings and appended claims.

DESCRIPTION

Figure 1:
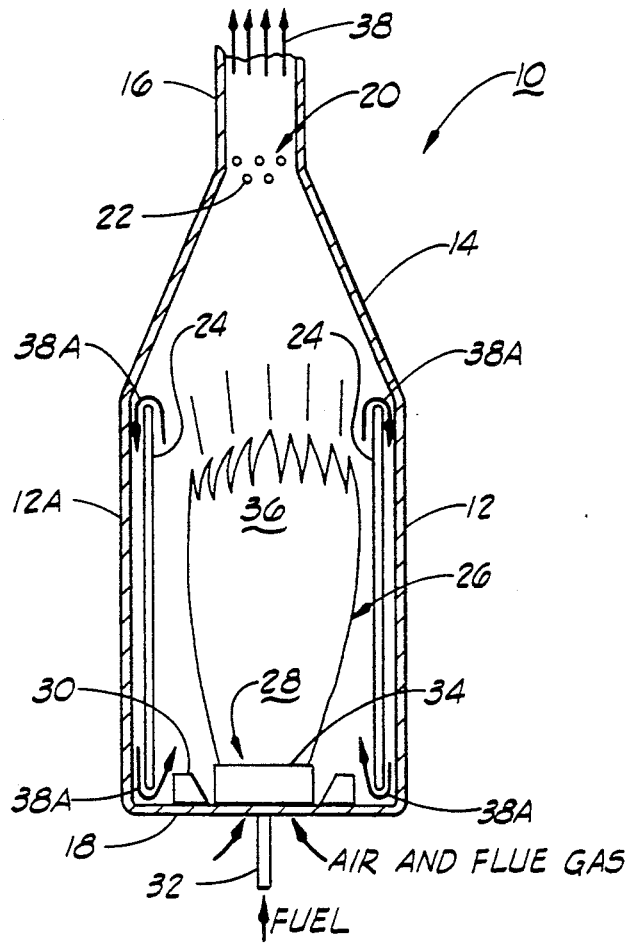
FIG. 1 PRIOR ART
FIG. 1 is a diagrammatical representation of a prior art tubular furnace assembly.

Referring to FIG. 1, shown therein is a tubular furnace assembly 10 which is typical of such units found in the prior art; that is, the furnace assembly 10 illustrates the components usually found in such prior art units.

The furnace assembly 10 has a cylindrically shaped body section 12, a converging medial section 14, a stack section 16, and a furnace floor 18. It will be appreciated that FIG. 1 is illustrative only, and that numerous details of the structure, such as valving, piping, controls, insulation etc., have been omitted throughout the drawings in order to present the disclosure more clearly as such details will be known by a person skilled in the combustion art.

The furnace assembly 10 has a convection section 20 in which is disposed a tube arrangement 22. Provided within the body section 12, and vertically extending along furnace wall 12A, are a plurality of wall tubes 24 which are interconnected to form, with the tube arrangement 22, a unitary heating structure which contains a flowing material, such as water, which is heated by the furnace assembly 10.

The furnace assembly 10 forms a combustion cavity 26 which is generally within the confine of the body section 12. A burner assembly 28 is supported on the furnace floor 18, and a flue gas deflection barrier 30 (or sometimes a burner tile or the like) is supported concentrically about the burner assembly 28. Fuel is fed via a fuel line 32 to a fuel dispensing nozzle (not shown) centrally disposed to a burner tile 34. Combustion air, or some other oxygen bearing fluid such as a mixture of air and externally recirculated flue gas, is fed to an inlet port (not shown) in the furnace floor 18.

Upon ignition by a flame ignitor (not shown), a combustion flame 36 is created in the combustion cavity 26 which produces combustion products exhausted as a flue gas effluent 38 from the stack section 16. As the combustion flame 36 heats the wall tubes 24 and the tube arrangement 22, temperature gradients necessarily occur throughout the tubular furnace assembly 10, causing internal recirculation of a port of the flue gas generated. Downdraft of flue gas is especially pronounced between the wall tubes 24 and the furnace wall 12A for the reason that the gases on the flame side of the wall tubes 24, due to direct exposure to the combustion flame 36, have a higher average temperature than do the gases between the back side of the wall tubes 24 and the furnace wall 12A. This results in downdrafted flue gas 38A as denoted by the flow arrows so enumerated in FIG. 1.

Figure 2:
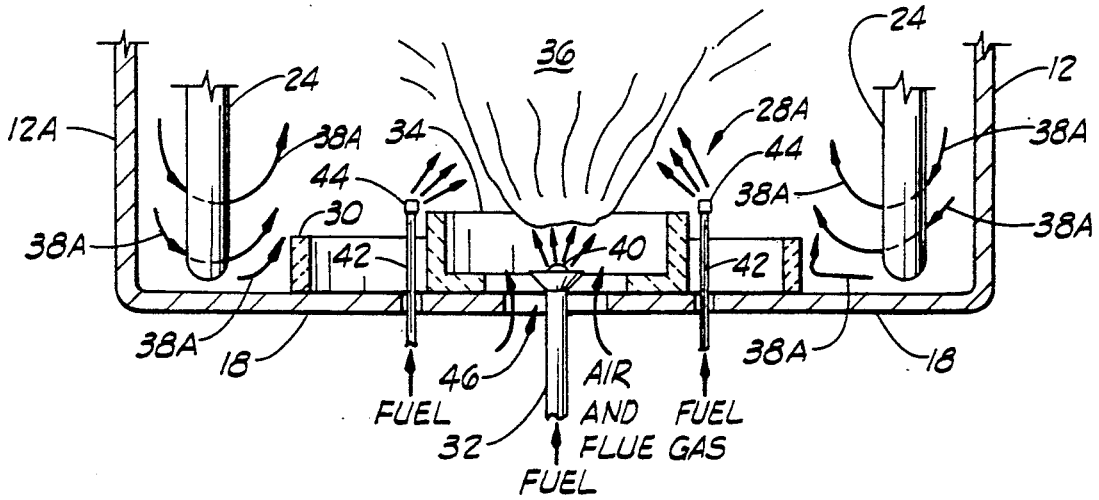
FIG. 2 PRIOR ART
FIG. 2 is a semi-detailed partial cutaway view of a prior art staged fuel burner assembly which finds use in a furnace assembly such as that depicted in FIG. 1.

FIG. 2 is a more detailed and enlarged view of a prior art burner assembly 28A, and with the exception that the burner assembly 28A is a staged fuel burner, it is identical to the above described burner assembly 28. Accordingly, the numerals used in FIG. 1 will be used in FIG. 2 to designate the same components. Thus, the burner assembly 28A has the fuel line 32 supporting a fuel dispensing nozzle 40, sometimes referred to as the primary fuel nozzle, and it has a plurality of fuel risers or lines 42 peripherally disposed about the burner tile 34. Supported on each of the upper ends of the fuel lines 42 is a secondary fuel dispensing nozzle 44. Combustion air, or a mixture of air and flue gas, is provided to the combustion flame 36 via an inlet port 46 in the furnace floor 18.

Usually, the major portion of fuel to the furnace assembly 10 is dispensed through the secondary fuel dispensing nozzles 44, while a minor portion of the fuel is dispensed via the first fuel dispensing nozzle 40. In some applications, once the combustion flame 36 is started and stabilized, the fuel to the first fuel dispensing nozzle 40 is reduced and sometimes eliminated during operation, in which case the first fuel dispensing nozzle 40 serves as a flame holder.

As depicted in FIG. 2, the downdrafted flue gas 38A passes downwardly between the wall tubes 24 and the furnace wall 12A and turns toward the combustion flame 36 where it is drawn upwardly along the outer edges of the flame envelope. The deflection barrier 30 serves to turn that portion of the downdrafted flue gas 38A which would flow toward the lower part of the combustion flame 36. The deflection barrier 30, also known as a Reed wall, or some other obstruction, such as burner tile or the like is commonly provided with prior art burner assemblies to minimize interaction of the downdrafted flue gas 38A with the combustion flame 36 at the fuel ignition point of the flame (that is, at the base of the flame) as such interaction results in flame instability, often causing flame snuffing or incomplete fuel combustion.

Figure 3:
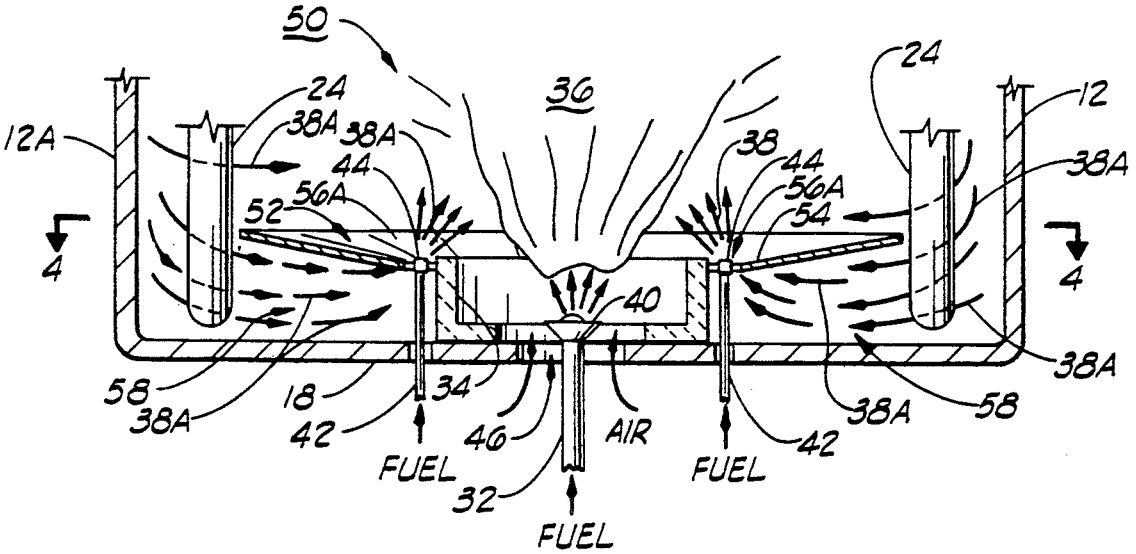
FIG. 3 is a semi-detailed, partial cutaway elevational view of a staged fuel burner assembly for a furnace and which incorporates the present invention.
Figure 4:
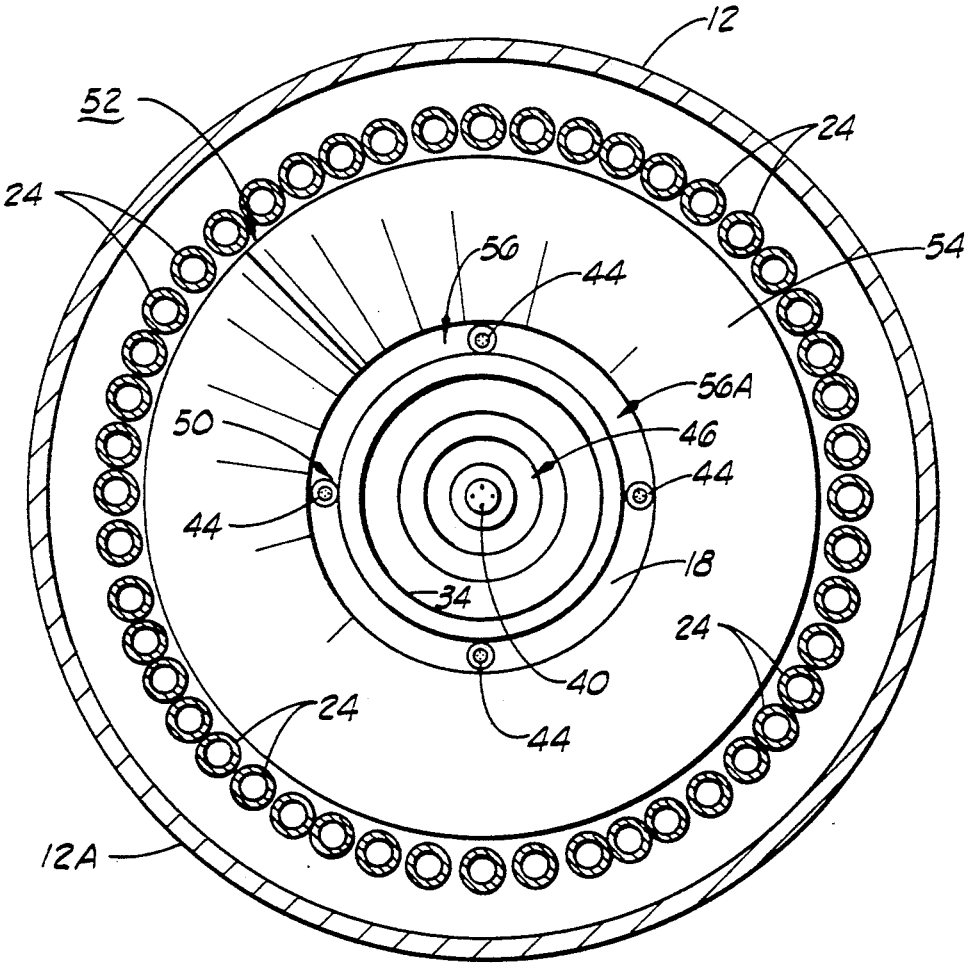
FIG. 4 is a plan view taken at 4—4 in FIG. 3.

FIGS. 3 and 4 depict a burner assembly 50 which is constructed in accordance with the present invention. The burner assembly 5 also is a staged fuel burner and is similar to the burner assembly 28A, with the exceptions that will be noted. The burner assembly 50 comprises the fuel line 32 central to, and extensive through, the combustion air inlet port 46 in the furnace floor 18. The burner tile 34 is a generally cylindrically shaped member which circumscribes the first fuel dispensing nozzle 40, and a plurality of fuel lines 42, supporting the secondary fuel dispensing nozzles 44, are peripherally disposed about the burner tile 34.

It will be noted that the burner assembly 50 does not have a fluid gas barrier such as the deflection barrier 30 shown with the burner assembly 28A. The purpose for the exclusion of such commonly used deflection barriers 30 will become clear hereinbelow.

The burner assembly 50 also comprises a flue gas recirculating system 52 which is disposed in the furnace assembly 10 for the purpose of flowing internal recirculating flue gas into combustion reaction with the combustion flame 36, leading to the minimization or elimination of $NO_x$ content in the flue gas effluent 38 from the stack 16. The flue gas recirculating system 52 has a flue gas gathering member 54, sometimes also referred to as a barrier member, which is disposed in close proximity to the furnace floor 18. The flue gas gathering member 54 has a central opening 56 which is, by positioning of the flue gas gathering member 54, disposed about the burner tile 34, leaving an annular gap 56A in which the secondary fuel dispensing nozzles 44 are disposed. The flue gas gathering member 54, in cooperation with the furnace floor 18, forms a flue gas tunnel 58, or passageway, which is open near the furnace wall 12A so that some portion of the downdrafted flue gas 38A is collected therein and caused to pass through the annular gap 56A.

The placement of the secondary fuel dispensing nozzles 44 in the annular gap 56A peripherally about the burner tile 34, and thus about the first fuel dispensing nozzle 40, causes the secondary fuel dispensing nozzles 44 to serve as aspirators and, cooperating with the flue gas gathering member 54, the secondary fuel dispensing nozzles 44 aspirate a quantity of the downdrafted flue gas 38A from the flue gas tunnel 58 through the flue gas discharge gap 56A. That is, as flue gas is dispensed from the secondary fuel dispensing nozzles 44 the downdrafted flue gas 38A in the flue gas tunnel 58 is aspirated or driven into the combustion cavity 26 to effect reaction with the combustion flame 36 so that the flue gas effluent 38 from the stack section 16 is caused to have a substantially diminished $NO_x$ content.

Figure 5:
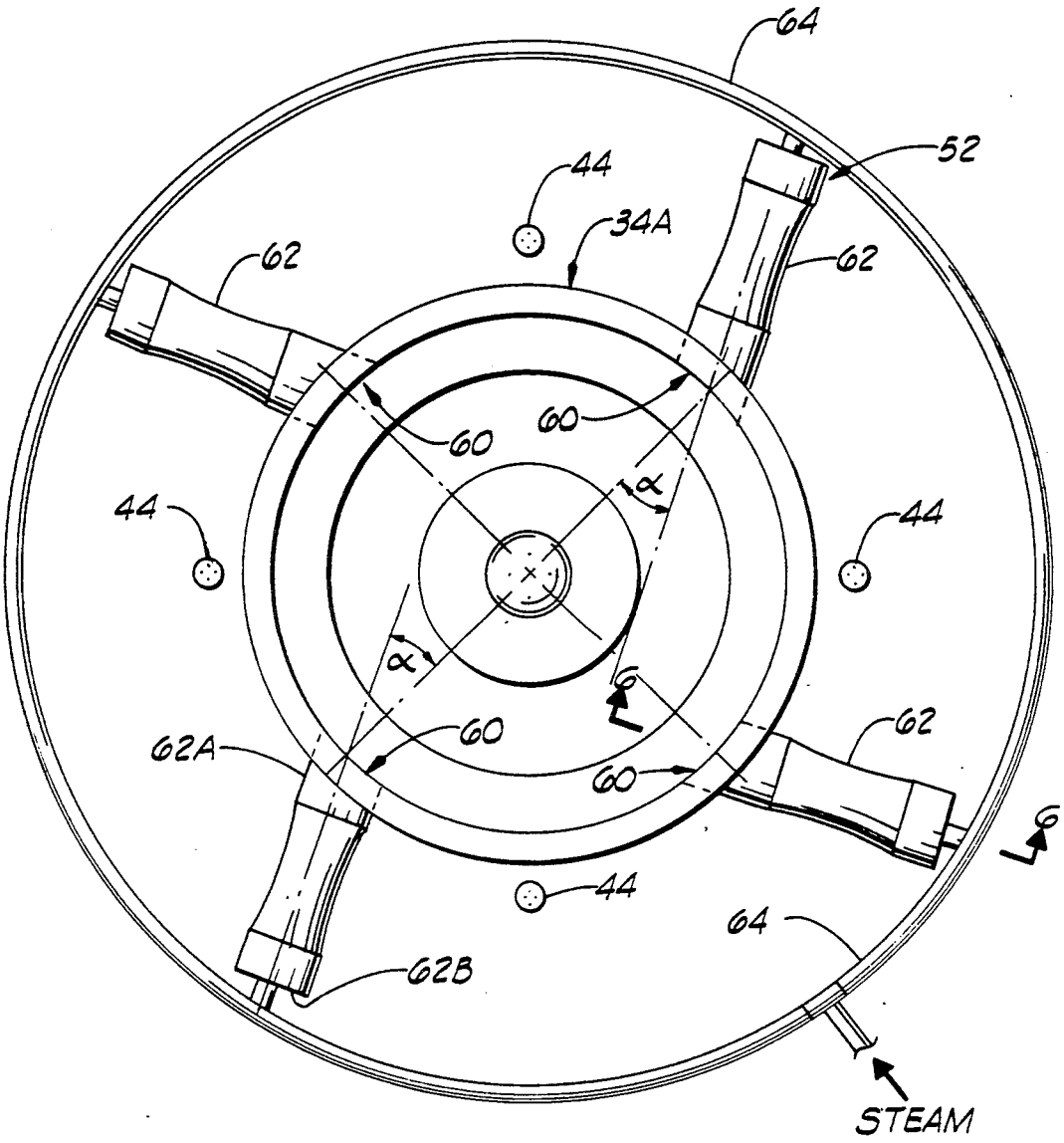
FIG. 5 is a plan view of a modified burner tile similar to that shown in FIG. 3 with the exception that the modified burner tile of FIG. 5 has been provided several access openings in which are mounted eductor pumps.
Figure 6:
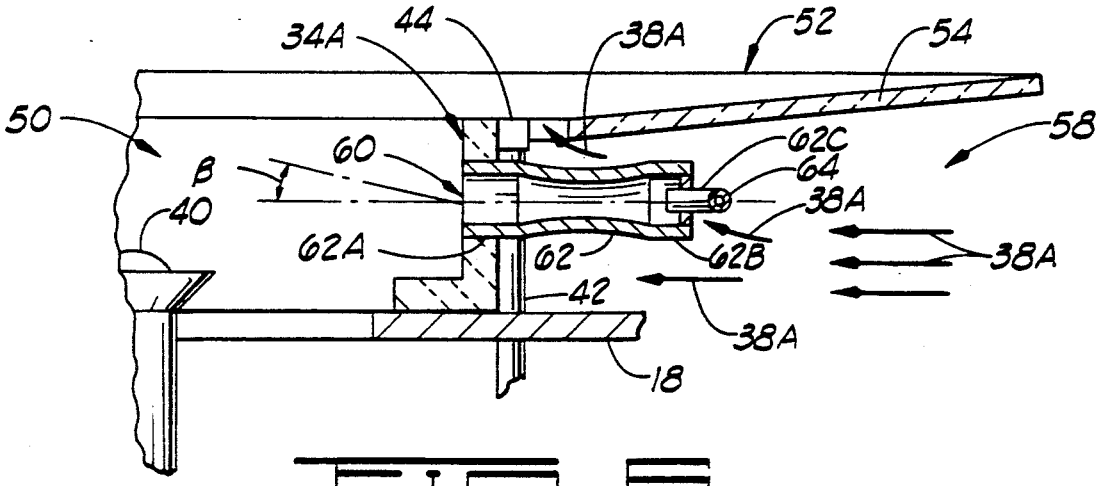
FIG. 6 is a view, somewhat enlarged, taken at 6—6 in FIG. 5.

The aspirating or driving force of the secondary fuel dispensing nozzles 44 is one way in which to pass the collected flue gas 38A from the flue gas tunnel 58 into the combustion zone 26. Another way is depicted in FIGS. 5 and 6. A burner tile 34A is provided which is identical to the burner tile 34 described hereinabove except that the burner tile 34A is provided with several access openings 60 extending through the cylindrical wall at angles $\alpha$ and/or $\beta$ sufficient to provide gas passage at a direction which is off center to the centrally disposed first fuel dispensing nozzle 40.

The flue gas recirculating force is provided by several eductor pumps 62, one each of such eductor pumps 62 being disposed to have its outlet end 62A fitted into one of the access openings 60 as shown in FIG. 6. The body of each eductor pump 62 has a diverging shape as is conventionally known, and is disposed in the tunnel 58 so that its open inlet end 62B is in communication with the collected flue gas 38A in the tunnel 58. A steam conduit 64 interconnects all of the eductor pumps 62 and provides pressurized steam to each of the eductor pumps 62 through a jet portion 62C at the inlet end 62B of each one. Pressurized steam is fed through the eductor pumps 62 where pressure head is converted to velocity head to draw flue gas 38A from the tunnel 58 and to forcefully propel the mixture of steam and flue gas toward the combustion flame 36. While steam is mentioned as the driving fluid since steam is a frequently available pressurized fluid, other pressurized fluids can also be used effectively to power the eductor pumps 62.

It should be noted that the flue gas recirculating system 52 can be provided with either the driving force of the secondary fuel dispensing nozzles 44 or the eductor pumps 62, or the flue gas recirculating system 52 can be provided with both the driving force of the secondary fuel dispensing nozzles 44 in combination with that of the eductor pumps 62.

The present invention was demonstrated by data obtained during an extensive test object. The test project was carried out using a furnace unit similar to that shown (FIGS. 3 through 6) and described hereinabove to determine the amount of $NO_x$ reduction achieved by the present invention.

The objective of the test project was to demonstrate that a burner constructed in accordance with the present invention will produce reduced levels of nitrogen oxides during a combustion process utilizing recirculation of combustion gas products within a fired tubular furnace. The prior art has demonstrated that reduced $NO_x$ levels can be achieved by externally recirculating the combustion products from a furnace stack to a burner. That is, a portion of the stack gas effluent is returned to the inlet of the burner. However, this method of recirculation requires substantial equipment and modification to the furnace. The present invention, using internal recirculation of flue gas, also results in reduced levels of $NO_x$ using a less expensive installation of structure as described hereinabove.

The test unit had a staged fuel burner which split the fuel into two streams to provide a primary and a secondary combustion zone within the combustion flame. The test unit using this burner showed that the present invention provides the ability to utilize internally recirculated combustion products to reduce $NO_x$ levels to substantially below that achieved by a conventional staged fuel burner.

Four parameters were identified that are known to have a major impact on the generation of $NO_x$ in a combustion process. These parameters are:

a. Fuel type
b. Oxygen content in the combustion products
c. Furnace temperature
d. Quantity of flue gas recirculation These parameters were studied in variation during the test project to obtain the necessary data to develop methods to predict the relative impact of each of the parameters on the generation of combustion generated $NO_x$.

Several fuels were tested because it is known that fuel selection has an impact on the level of $NO_x$ formed. The fuels tested were:

a. Natural gas
b. 80% hydrogen, 20% natural gas
c. 30% hydrogen, 35% natural gas, 35% propane
d. 50% hydrogen, 50% natural gas
e. 50% hydrogen, 30% natural gas, 20% propane Because a high oxygen content promotes formation of nitrogen oxides, the test unit was operated at a flue gas oxygen content ranging from less than 1% to greater than 6% by volume.

It is known that the production of $NO_x$ increases with increased combustion temperatures, and one factor that influences the combustion temperature is the operating temperature of the furnace. The operating temperatures were varied in the manner described hereinbelow.

The major parameter investigated by the test project was the rate of internal flue gas recirculation. The primary difference between the burner assembly of the present invention and that of a conventional burner is the ability of the present invention to utilize internally recirculated flue gas to further reduce the formation of $NO_x$ during a combustion process. Several recirculation rates of flue gas were investigated, with the recirculation flue gas being injected into the primary combustion zone by steam driven eductor pumps. Eductor steam pressure was used as a measure of the recirculation rate.

The test unit on which the test project data was obtained was first operated in a configuration generally in conformity with that shown in FIGS. 1 and 2 herein. That is, the test unit was first operated without the installation of the flue gas recirculation system of the present invention for the purpose of establishing baseline $NO_x$ emission levels for the furnace before the installation of the present invention. This data is presented in Table 1 in which is recorded the results of four separate runs using natural gas as the fuel.

The staged fuel burner was run utilizing 30% of the fuel to the primary (center) fuel nozzle and 70% of the fuel to the secondary fuel nozzles peripherally disposed about the primary fuel nozzle. Air was introduced into the burner in a single stage central opening by natural draft.

The following parameters were measured: stack temperature; firebox temperature; and firing rate (reported in million BTUs per hour). The stack gas effluent was monitored using a Teledyne Max 5 flue gas analyzer to determine the excess oxygen ($O_2$%) and carbon monoxide (CO ppm). $NO_x$ emission was measured using a Thermo Electron Model 10 chemiluminescent $NO_x$ analyzer ($NO_x$ ppm). $NO_x$ is normally reported at 3 percent excess oxygen; therefore, the measured $NO_x$ was corrected to this level and is reported as $NO_x$ (corrected ppm).

It should be noted that Run 4 in Table 1 is at a reduced firing rate (1.4 MMBTU/HR) and at a high excess oxygen level (13.81%). This represents the high $NO_x$ emission level achieved during a startup or during a hot standby condition.

As Table 1 reflects, the corrected $NO_x$ achieved during the four runs was as follows: Run 1=34.6 ppm; Run 2=38.7 ppm; Run 3=38.7 ppm; and Run 4=53.8 ppm.

Portions of the data of the test project are presented herein by tables to provide the results and to demonstrate the $NO_x$ reduction achieved by the present invention. The following examples are given for illustrative purposes and are not to be construed as limiting the present invention as defined in the appended claims.

The following examples discuss the data obtained with the furnace modified by the addition of the present invention as described hereinabove for FIGS. 3 through 6. In all runs the secondary fuel nozzles were aspirating internal recirculating flue gas into the second stage combustion zone of the combustion flame. The data of the tests are reported identically to that in Table I with the exception that steam driver pressure (STM DRV PF) in psig is added. This parameter is the driving force to cause the eductor pumps to move the internal recirculating flue gas into the primary combustion zone. It should be noted in Table 2 that the lower $NO_x$ emission levels recorded when the steam driver pressure is zero (0) were caused by the aspiration effect of the secondary fuel nozzles on the internal recirculating flue gas.

Table II is broken down into 9 tests, and each of these tests has a plurality of runs to demonstrate the effect of the different variables. A description of each such test follows.

EXAMPLE 1

Test 1. The test fuel was natural gas. Effluent oxygen concentration was held in the 2.5% range over the 6 runs that made up the test. The furnace temperature was held as near 1300° F. as possible. Firing rate was held at a constant 4.4 MM BTU/hr. Fuel split was 70% secondary fuel nozzles and 30% primary fuel nozzle. Internally recirculated flue products were driven by means of the eductors into the primary combustion zone. As the eductor pressure increased more internally recirculated flue gas was moved from the gathering system area into the primary combustion zone. Runs 1 thru 6 show the downward trend of $NO_x$ formation caused by the injection of internally recirculated flue gas into the primary combustion zone. Run 1, with no recirculation into the primary zone by the eductor pumps, while showing a sizable reduction from the baseline data, did not meet the effluent $NO_x$ requirement of approximately 25 ppm for natural gas fuel. By adding recirculated flue gas into the primary combustion zone by the eductor pumps in steps, a gradual decrease in the $NO_x$ emissions was noted. Run #6 shows total $NO_x$ emission from the furnace of 13.2 ppm. This represents a reduction of 62% from the baseline data. It also demonstrates a reduction of 48% from the furnace configuration without the primary zone eductors. This results in a substantial reduction from the target (0.03 LBS/MM BTU) $NO_x$ emission.

EXAMPLE 2

Test 2. Test block conditions were held constant as in Test 1 with the exception that the effluent oxygen concentration was increased to approximately 3%. The fuel was natural gas.

Run 7 shows a $NO_x$ emission of 28.6 ppm without the eductor pumps being utilized (STM DRV PR=0). This represents a reduction of 17% when compared with the baseline data. Runs 8–11 show the effect of the educted flue gas when introduced into the primary combustion zone. When data from Run 11 is compared with the baseline data, a reduction of 44% in NOx emission is shown. When Run 11 data is compared with Run 7, a reduction of 47% in NOx reduction is shown. These reductions show the effect of using both the flue gas gathering member and the eductor pumps. The rise in the corrected $NO_x$ shows the effect of effluent oxygen concentration on thermal $NO_x$ production.

EXAMPLE 3

Test 3. The fuel was natural gas, and the firing rate (4.4 MM BTU/HR) was held at the same rate as in Tests 1 and 2. The effluent oxygen concentration was held around 2.5%. The box temperature was raised to around 1375° F. Fuel split was altered to pass 80% through the secondary fuel nozzles and 20% through the primary fuel nozzle. Again, the eductor pressure (STM DRV PR) was varied. Run No. 12 registered a $NO_x$ emission level of 25.5 ppm. When this data is compared with the baseline data of Table I, a reduction of 26% was achieved. As the eductor pressure was increased in Runs 13–16, a decrease in $NO_x$ emission was experienced. The best result is shown in Run #16 (12.2 ppm). This shows a reduction from the baseline of 65% and a reduction from Run #12 of 52%. The lower $NO_x$ emissions were attributed to the change in fuel split.

EXAMPLE 4

Test 4. The fuel was 80% hydrogen and 20% natural gas. The firing rate was 4.5 MM BTU/HR. Fuel split was 70% to the secondary fuel nozzles and 30% to the primary fuel nozzle. The oxygen concentration was held in the 2–3% range. The furnace temperature was held around 1300° F. Runs 17–19 show the effect of using the eductor pumps to inject internally recirculated gas into the primary combustion zone of the flame. The $NO_x$ emission limit for this fuel at 0.03 LBS/MM BTUs is around 30 ppm. Run 18 achieved the best reduction (32%) compared with the 0.03 LBS/MM BTUs limit. The fuel utilized in this test is known to be a high $NO_x$ producer is typical of fuels found in certain petrochemical process plants.

EXAMPLE 5

Test 5. The fuel was natural gas. The furnace temperature was held around 1500° F. The eductor pressure was maintained fairly constant. Heat release was held at 4.5 MM BTU/HR for Runs 20–23. Fuel split was 70% to the secondary fuel nozzles and 30% to the primary fuel nozzle. Oxygen concentration was varied from around 2% to 4.8%. Run 21 demonstrated the effect of effluent oxygen concentration on $NO_x$ emission when compared with Run 22. As expected, the $NO_x$ emission rose with increasing oxygen concentration. Still, a substantial reduction (51%) was achieved when comparing Run 21 to the baseline data of Table I. When compared with the $NO_x$ emission limit of 0.03 lbs/MM BTUs (25 ppm) for natural gas as the operating fuel, a reduction of 32% was demonstrated.

EXAMPLE 6

Test 6. The fuel was a mixture of 30% hydrogen, 35% natural gas and 35% propane. This represents a typical refinery fuel gas. The eductor pressure (STM DRV PR) was varied. The furnace temperature was varied from 1300° F. to 1575° F. The firing rate was held constant at 4.5 MM BTU/Hr. Fuel split was 70% to the secondary fuel nozzles and 30% to the primary fuel nozzle. The effluent oxygen concentration was varied in the 2 to 4 percent range. The allowable $NO_x$ emission limit of 0.03 lbs/MM BTUs level for this fuel equates to a NOx emission of 25.2 ppm. Runs No. 24–28 show the effect of the increasing the furnace temperature on the $NO_x$ emission level. The eductor pressure was held at a low rate in these five runs. It will be noted that the $NO_x$ emission limit exceeds the allowable 25.2 ppm limit. Also, in Runs 24–28 the oxygen concentration was varied from 1.8% to 3.15% Runs 29–36 were run at a fairly constant furnace temperature at around 1500° F. The eductor pressure in Runs 29–36 was varied in excess of the previous runs. This resulted in a lowering of the corrected $NO_x$ emissions. Run 34, with the oxygen concentration at 3.8%, showed a corrected $NO_x$ level of 21.7 ppm. When compared with Run 27, Run 34 shows a reduction in the $NO_x$ emission of 26% in spite of a 100° F. furnace temperature increase. Test 36 shows that at 1.85% oxygen concentration and at 1500° F. box temperature, a reduction of 38% was achieved relative to Run 27. A difference of 15% was demonstrated between Run 34 and the 0.03 lbs/MM BTU limit.

EXAMPLE 7

Test 7. The fuel was a mixture of 50% hydrogen and 50% natural gas. The eductor pressure was varied between runs, and the furnace temperature was varied as well as oxygen content. The firing rate was held constant at 4.5 MM BTU/Hr. Fuel split was 70% to the secondary fuel nozzles and 30% to the primary fuel nozzle. The allowable $NO_x$ emission level of 0.03 lbs/MM BTUs equates to a limit of 27.0 ppm for this fuel. Run 37 can be used as a baseline for this fuel. It shows a corrected $NO_x$ of 31.3 ppm and a box temperature of approximately 1300° F. Runs 38–42 varied the oxygen concentration and the box temperature while holding the eductor pressure (STM DRV PR) constant at 12.0 psig. A marked decrease in the $NO_x$ emission in Runs 38–42 was demonstrated when compared to that of Run 37. A 45% decrease in the $NO_x$ emission was shown in Run 38 as compared to that of Run 37. The variance in the reported $NO_x$ emission levels in Runs 38–42 is believed to be attributable to the changing furnace temperature. Runs 43–45 show the oxygen concentration held at approximately 2%; the furnace temperature at approximately 1500°; and the eductor pressure varied from 15 to 25 psig. A reduction of nearly 45% was achieved in Run 45 as compared with that of Run 37. All of the $NO_x$ emission levels of Runs 38–45 were below the allowable level of 27.0 ppm.

EXAMPLE 8

Test 8. The fuel was 50% hydrogen, 30% natural gas and 20% propane, again representing a typical refinery fuel gas. The 0.03 lbs/MM BTUs level for this fuel is 26.1 ppm. Runs 46–50 were conducted at a 3.8 MM BTU/HR heat release. Runs 51 and 52 were at 4.75 MM BTU/HR, and Run 53 represents a turn down case at 1.4 MM BTU/HR All runs were at a constant eductor pressure. In Runs 46–49, with the firebox temperature of approximately 1350° F., the $O_2$ was varied from 2.18% to 6.03%. Runs 51 and 52 were conducted at a constant 1400° F. box temperature, and $O_2$ concentration was varied from 1.7% to 3.6%. Run 53 represents the conditions experienced for a furnace during a turn down, a start up condition or a hot standby condition as this run was conducted with a high excess oxygen concentration of 6.3%. All of the reported $NO_x$ emission levels were under the 26.1 ppm limit. It should also be noted that the eductor pressure was not decreased during Run 53, indicating the high stability of the flame.

EXAMPLE 9

Test 9. The fuel was 30% hydrogen, 35% natural gas and 35% propane. Again, the eductor pressure was held fairly constant at 20.0 and 25.0 psig. The firebox temperature was allowed to increase from a startup condition of 825° F. to a maximum of 1450° F. The oxygen concentration was varied from between 1.95% to 5.85%. The allowable NOx emission limit of 0.03 lbs/MM BTUs for this fuel is 25.2. Run 54 shows a furnace turn down condition with a high excess oxygen concentration of 7.13%, and the $NO_x$ emission level of 29.2 ppm exceeds the allowed level of 25.2 ppm. Runs 55–59 were conducted at 3.8 MM BTU/HR heat release and at a fairly constant box temperature of 1375° F. The $NO_x$ emission levels for Runs 55–59 were below the acceptable 25.2 ppm limit. Runs 60–62 were conducted with an increase in firing rate to 4.75 MM BTU/HR and the oxygen concentration was varied between 1.95% and 4.15%. Again, in Runs 60–62 the $NO_x$ was below the 25.2 ppm limit.

In conclusion, a wide range of fuels and firing conditions have been demonstrated by the above described examples. The fuels ranged from natural gas, to a heavy fuel gas mixture to a light fuel gas mixture in terms of specific gravity. In most instances the $NO_x$ emission levels rotated in Table 2 were below the regulatory permitted level 0.03 lbs/MM BTUs. When the eductor pressure (ST DRV PR) was 15 psig or greater, and when effluent oxygen concentration was below 7%, all fuels tested had $NO_x$ emission levels below the 0.03 lbs/MM BTUs level. When compared with baseline data for the natural gas fuels, the data of Table 2 demonstrates a 65% reduction in the emission level of $NO_x$.

It will be clear that the present invention is well adapted to carry out the objects and attain the advantages mentioned as well as those inherent therein. While presently preferred embodiments of the invention have been described for purposes of this desclosure, numerous changes can be made which will readily suggest themselves to those skilled in the art and which are encompassed within the spirit of the invention disclosed and as defined in the appended claims.

TABLE 1

| | BASELINE DATA | | | |
|---|---|---|---|---|
| RUN NUMBER | 1 | 2 | 3 | 4 |
| $O_2$ (%) | 1.87 | 2.20 | 2.10 | 13.81 |
| $NO_X$ (MEASURED PPM) | 36.8 | 40.4 | 40.6 | 21.5 |
| $NO_X$ (CORRECTED PPM) | 34.6 | 38.7 | 38.7 | 53.8 |
| CO (PPM) | 76.0 | 29.0 | 24.0 | 141.0 |
| STACK TEMP (°F.) | 1308 | 1388 | 1410 | 901 |
| FIREBOX TEMP (°F.) | 1314 | 1379 | 1403 | 1009 |
| HEAT REL (MMBTU/HR) | 4.5 | 4.5 | 4.5 | 1.4 |

TABLE 2

| TEST DATA | | | | | | | | | | | |
|---|---|---|---|---|---|---|---|---|---|---|---|
| TEST | 1 | | | | | | 2 | | | | |
| RUN NUMBER | 1 | 2 | 3 | 4 | 5 | 6 | 7 | 8 | 9 | 10 | 11 |
| $O_2$ (%) | 2.58 | 2.50 | 2.38 | 2.48 | 2.47 | 2.42 | 3.11 | 2.97 | 2.81 | 3.16 | 3.13 |
| $NO_X$ (MEASURED PPM) | 27.4 | 22.1 | 20.0 | 18.5 | 19.0 | 13.6 | 28.5 | 25.2 | 19.5 | 17.6 | 15.1 |
| $NO_X$ (CORRECTED PPM) | 26.8 | 21.5 | 19.3 | 18.0 | 18.4 | 13.2 | 28.6 | 25.2 | 19.3 | 17.7 | 15.2 |
| CO (PPM) | 56.0 | 51.0 | 46.0 | 53.0 | 109.0 | 214.0 | 23.0 | 27.0 | 40.0 | 52.0 | 129.0 |
| STACK TEMP (°F.) | 1276 | 1308 | 1332 | 1330 | 1331 | 1318 | 1310 | 1322 | 1323 | 1313 | 1313 |
| FIREBOX TEMP (°F.) | 1321 | 1333 | 1338 | 1329 | 1361 | 1297 | 1323 | 1326 | 1323 | 1304 | 1299 |
| HEAT REL (MMBTU/HR) | 4.4 | 4.4 | 4.4 | 4.4 | 4.4 | 4.4 | 4.4 | 4.4 | 4.4 | 4.4 | 4.4 |
| STM DRV PR (PSIG) | 0 | 2 | 4 | 6 | 10 | 12 | 0 | 2 | 6 | 10 | 14 |

| TEST | 3 | | | | | 4 | | |
|---|---|---|---|---|---|---|---|---|
| RUN NUMBER | 12 | 13 | 14 | 15 | 16 | 17 | 18 | 19 |
| $O_2$ (%) | 2.61 | 2.54 | 2.35 | 2.51 | 2.32 | 2.83 | 2.02 | 2.47 |

TABLE 2-continued

| TEST DATA | | | | | | | | |
|---|---|---|---|---|---|---|---|---|
| $NO_X$ (MEASURED PPM) | 26.0 | 18.7 | 16.7 | 15.0 | 12.7 | 25.8 | 21.6 | 21.4 |
| $NO_X$ (CORRECTED PPM) | 25.5 | 18.3 | 16.1 | 14.6 | 12.2 | 25.6 | 20.5 | 20.8 |
| CO (PPM) | 25.0 | 144.0 | 212.0 | 162.0 | 458.0 | 46.0 | 40.0 | 36.0 |
| STACK TEMP (°F.) | 1365 | 1406 | 1410 | 1408 | 1410 | 1257 | 1303 | 1315 |
| FIREBOX TEMP (°F.) | 1365 | 1385 | 1385 | 1378 | 1377 | 1335 | 1349 | 1335 |
| HEAT REL (MMBTU/HR) | 4.4 | 4.4 | 4.4 | 4.4 | 4.4 | 4.5 | 4.5 | 4.5 |
| STM DRV PR (PSIG) | 0 | 4 | 8 | 10 | 15 | 15 | 25 | 35 |

| TEST | 5 | | | | 6 | | | | | | |
|---|---|---|---|---|---|---|---|---|---|---|---|
| RUN NUMBER | 20 | 21 | 22 | 23 | 24 | 25 | 26 | 27 | 28 | 29 | 30 |
| $O_2$ (%) | 2.38 | 4.77 | 2.12 | 1.86 | 2.92 | 2.85 | 1.84 | 3.15 | 3.08 | 2.93 | 2.16 |
| $NO_X$ (MEASURED PPM) | 13.8 | 15.3 | 13.9 | 13.1 | 25.0 | 33.9 | 23.6 | 29.2 | 29.6 | 24.1 | 26.1 |
| $NO_X$ (CORRECTED PPM) | 13.4 | 16.9 | 13.3 | 12.3 | 24.9 | 33.6 | 22.2 | 29.4 | 29.8 | 24.0 | 24.9 |
| CO (PPM) | 13.0 | 13.0 | 12.0 | 11.0 | 26.0 | 79.0 | 64.0 | 48.0 | 38.0 | 32.0 | 30.0 |
| STACK TEMP (°F.) | 1509 | 1505 | 1537 | 1542 | 1289 | 1307 | 1352 | 1397 | 1471 | 1505 | 1539 |
| FIREBOX TEMP (°F.) | 1519 | 1486 | 1538 | 1543 | 1290 | 1341 | 1364 | 1397 | 1476 | 1524 | 1570 |
| HEAT REL (MMBTU/HR) | 4.5 | 4.5 | 4.5 | 4.5 | 4.5 | 4.5 | 4.5 | 4.5 | 4.5 | 4.5 | 4.6 |
| STM DRV PR (PSIG) | 11.5 | 10.5 | 10.5 | 14.0 | 2.0 | 2.5 | 5.0 | 4.5 | 4.5 | 10.0 | 12.0 |

| TEST | 6 | | | | | | 7 | | | | |
|---|---|---|---|---|---|---|---|---|---|---|---|
| RUN NUMBER | 31 | 32 | 33 | 34 | 35 | 36 | 37 | 38 | 39 | 40 | 41 |
| $O_2$ (%) | 2.45 | 2.09 | 3.45 | 3.79 | 2.00 | 1.85 | 2.91 | 2.56 | 3.18 | 3.10 | 3.85 |
| $NO_X$ (MEASURED PPM) | 21.5 | 19.9 | 20.8 | 20.8 | 21.5 | 19.5 | 31.4 | 17.7 | 18.8 | 21.2 | 22.8 |
| $NO_X$ (CORRECTED PPM) | 20.9 | 18.9 | 21.3 | 21.7 | 20.3 | 18.3 | 31.3 | 17.3 | 18.9 | 21.4 | 23.9 |
| CO (PPM) | 25.0 | 24.0 | 24.0 | 24.0 | 22.0 | 21.0 | 18.0 | 31.0 | 9.0 | 10.0 | 11.0 |
| STACK TEMP (°F.) | 1530 | 1521 | 1511 | 1505 | 1513 | 1495 | 1303 | 1298 | 1381 | 1453 | 1457 |
| FIREBOX TEMP (°F.) | 1524 | 1514 | 1487 | 1477 | 1498 | 1463 | 1293 | 1288 | 1393 | 1473 | 1468 |
| HEAT REL (MMBTU/HR) | 4.5 | 4.5 | 4.5 | 4.5 | 4.5 | 4.5 | 4.5 | 4.5 | 4.5 | 4.5 | 4.5 |
| STM DRV PR (PSIG) | 15.0 | 20.0 | 22.0 | 20.0 | 15.0 | 28.0 | 2.5 | 12.0 | 12.0 | 12.0 | 12.0 |

| TEST | 7 | | | | 8 | | | | | | | |
|---|---|---|---|---|---|---|---|---|---|---|---|---|
| RUN NUMBER | 42 | 43 | 44 | 45 | 46 | 47 | 48 | 49 | 50 | 51 | 52 | 53 |
| $O_2$ (%) | 1.80 | 2.13 | 2.06 | 2.13 | 2.18 | 2.98 | 4.02 | 4.55 | 6.03 | 1.70 | 3.60 | 6.30 |
| $NO_X$ (MEASURED PPM) | 20.0 | 19.4 | 17.4 | 18.0 | 20.0 | 20.0 | 20.7 | 20.6 | 20.6 | 20.9 | 23.1 | 18.6 |
| $NO_X$ (CORRECTED PPM) | 18.8 | 18.5 | 16.5 | 17.2 | 19.1 | 20.0 | 21.9 | 22.5 | 24.7 | 19.5 | 23.9 | 22.0 |
| CO (PPM) | 8.0 | 8.0 | 7.0 | 7.0 | 57.0 | 21.0 | 20.0 | 18.0 | 18.0 | 17.0 | 18.0 | 261 |
| STACK TEMP (°F.) | 1488 | 1491 | 1484 | 1476 | | | | | | | | |
| FIREBOX TEMP (°F.) | 1511 | 1509 | 1591 | 1478 | 1388 | 1353 | 1345 | 1340 | 1292 | 1416 | 1399 | 961 |
| HEAT REL (MMBTU/HR) | 4.5 | 4.5 | 4.5 | 4.5 | 3.8 | 3.8 | 3.8 | 3.8 | 3.8 | 4.75 | 4.75 | 1.4 |
| STM DRV PR (PSIG) | 12.0 | 15.0 | 20.0 | 25.0 | 25.0 | 25.0 | 25.0 | 25.0 | 25.0 | 25.0 | 25.0 | 25.0 |

| TEST | 9 | | | | | | | | |
|---|---|---|---|---|---|---|---|---|---|
| RUN NUMBER | 54 | 55 | 56 | 57 | 58 | 59 | 60 | 61 | 62 |
| $O_2$ (%) | 7.13 | 2.27 | 2.66 | 4.17 | 5.85 | 5.21 | 2.16 | 1.95 | 4.15 |
| $NO_X$ (MEASURED PPM) | 22.5 | 16.9 | 19.4 | 18.6 | 18.2 | 16.7 | 16.2 | 18.0 | 20.9 |
| $NO_X$ (CORRECTED PPM) | 29.2 | 16.2 | 19.0 | 19.9 | 21.6 | 19.0 | 15.5 | 17.0 | 22.3 |
| CO (PPM) | 106.0 | 36.0 | 33.0 | 29.0 | 28.0 | 26.0 | 20.0 | 19.0 | 19.0 |
| STACK TEMP (°F.) | | | | | | | | | |
| FIREBOX TEMP (°F.) | 825 | 1384 | 1434 | 1377 | 1349 | 1313 | 1380 | 1436 | 1450 |
| HEAT REL (MMBTU/HR) | 1.4 | 3.8 | 3.8 | 3.8 | 3.8 | 3.8 | 4.75 | 4.75 | 4.75 |
| STM DRV PR (PSIG) | 20.0 | 25.0 | 25.0 | 25.0 | 20.0 | 20.0 | 20.0 | 20.0 | 20.0 |

What is claimed is:

1. An improved burner assembly for a furnace having a combustion zone in which internally recirculating flue gas is created by a combustion flame therein, the furnace having a wall portion and a furnace floor with an inlet port for intake of a combustion supporting fluid, the burner assembly comprising:

burner means for combusting a fuel with the combustion supporting fluid to produce the combustion flame, the burner means comprising:

a primary fuel nozzle disposed at the inlet port;

a burner tile supported by the furnace floor and surrounding the primary fuel nozzle; and a plurality of secondary fuel nozzles extending from the furnace floor and peripherally disposed about the burner tile;

means for directing internally recirculating flue gas in the furnace into reaction contact with the combustion flame so that the collected internally recirculating flue gas is reacted with the combustion flame so that the $NO_x$ content of the flue gas exhausted from the furnace is substantially diminished while maintaining stability of the combustion flame, the means for directing internally recirculating flue gas comprising:

eductor means for driving internal flue gas into the combustion flame when passing a pressurized fluid, the eductor means having at least one eductor pump with an inlet end thereof in communication with internal flue gas and an outlet end directed towards the combustion flame zone; and flue gas gathering means for collecting and directing internal flue gas to the eductor means so that the inlet of each eductor pump is supplied internal flue gas, the flue gas gathering means comprising:

a barrier disposed in proximity to the furnace floor portion and cooperating therewith to form a flue gas tunnel, the flue gas tunnel having an opening to collect internally recirculating flue gas from near the wall of the furnace, the fluid gas tunnel having fluid communication with the inlet of each eductor pump, the secondary fuel nozzles and the flue gas tunnel cooperating to aspirate a portion of the collected flue gas into the combustion flame.

2. The burner assembly of claim 1 wherein the burner tile has a cylindrically shaped wall portion with plural access openings equal in number to the number of eductor pumps, each of the eductor pumps disposed at one of the access openings to drive collected internally recirculating flue gas therethrough.

3. In combination with a furnace which in operation contains a combustion flame and which exhausts a flue gas effluent, an improved burner assembly comprising:

burner means for combustion a fuel with an oxygen bearing fluid to produce the combustion flame, the burner means comprising:

first fuel dispensing means for dispensing a selected first portion of fuel, the first fuel dispensing means comprising a centrally disposed primary fuel nozzle;

second fuel dispensing means for dispensing the remaining fuel and comprising a plurality of secondary fuel nozzles peripherally disposed about the first fuel nozzle; and flue gas recirculating means disposed in the furnace for flowing internally recirculating flue gas into combustion reaction with the combustion flame so that the $NO_x$ content of the exhausted flue gas is substantially diminished, the flue gas recirculating means also directing collected internal flue gas to the secondary fuel nozzle so that a portion of the internally recirculated flue gas is aspirated into the combustion flame, the flue gas recirculating means comprising:

eductor means for driving internal flue gas into the combustion flame when passing a pressurized fluid, the eductor means having at least one eductor pump with an inlet end thereof in communication with internal fluid gas and an outlet end directed towards the combustion flame zone; and flue gas gathering means disposed in the furnace for collecting and directing internal flue gas to the eductor means so that the inlet of each eductor pump is supplied internal flue gas.

* * * * *